US008502092B2

(12) United States Patent
Chou

(10) Patent No.: US 8,502,092 B2
(45) Date of Patent: Aug. 6, 2013

(54) ROTARY SWITCH MECHANISM

(75) Inventor: Kuan-Nan Chou, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 334 days.

(21) Appl. No.: 12/955,687

(22) Filed: Nov. 29, 2010

(65) Prior Publication Data

US 2012/0055763 A1 Mar. 8, 2012

(30) Foreign Application Priority Data

Sep. 3, 2010 (TW) ..... 099129827

(51) Int. Cl.
*H01H 3/02* (2006.01)

(52) U.S. Cl.
USPC ..... 200/4; 200/14

(58) Field of Classification Search
USPC ..... 200/4, 5 R, 11 R–11 DA, 14, 17 R, 200/18, 565, 573, 574, 310–316, 336; 341/20, 341/22, 35; 345/156, 157, 160, 161, 168, 345/169, 184; 455/575.1
See application file for complete search history.

(56) References Cited

U.S. PATENT DOCUMENTS

| | | | | |
|---|---|---|---|---|
| 4,166,200 | A * | 8/1979 | Reichen et al. | 200/11 R |
| 5,436,413 | A * | 7/1995 | Katakami | 200/14 |
| 5,665,946 | A * | 9/1997 | Nishijima et al. | 200/4 |
| 5,705,778 | A * | 1/1998 | Matsui et al. | 200/11 R |
| 5,761,554 | A * | 6/1998 | Kirigaya et al. | 396/299 |
| 5,847,335 | A * | 12/1998 | Sugahara et al. | 200/4 |
| 6,049,044 | A * | 4/2000 | Mizobuchi | 200/4 |
| 6,667,446 | B1 * | 12/2003 | Schuberth et al. | 200/4 |
| 6,670,567 | B1 * | 12/2003 | Koseki et al. | 200/564 |
| 7,105,754 | B2 * | 9/2006 | Turner | 200/4 |
| 8,164,009 | B2 * | 4/2012 | Kagami et al. | 200/14 |
| 8,217,742 | B2 * | 7/2012 | Trudeau et al. | 335/205 |

* cited by examiner

*Primary Examiner* — Michael Friedhofer
(74) *Attorney, Agent, or Firm* — Kirton McConkie; Evan R. Witt

(57) ABSTRACT

A rotary switch mechanism includes a hollow cylinder, a base, a push button, a first rotatable member, a second rotatable member, a first switch, a second switch and a third switch. The base is disposed under the hollow cylinder. The first rotatable member is sheathed around the hollow cylinder. The second rotatable member is sheathed around the first rotatable member. The first switch is disposed beside the first rotatable member. The second switch is disposed beside the second rotatable member. The third switch is mounted on a first circuit board, which is disposed under the base. The first rotatable member and the first switch interact with each other to generate a first rotating signal. The second rotatable member and the second switch interact with each other to generate a second rotating signal. The third switch is triggered by the pressing rod to generate a pressing signal.

9 Claims, 6 Drawing Sheets

ROTARY SWITCH MECHANISM

FIELD OF THE INVENTION

The present invention relates to a rotary switch mechanism, and more particularly to a two-layered rotary switch mechanism.

BACKGROUND OF THE INVENTION

A rotary switch mechanism is usually installed in for example a computer peripheral device to generate a control signal. In response to the control signal, a specified function (e.g. a sound volume adjusting function) may be executed.

FIG. 1 is a schematic exploded view illustrating a conventional rotary switch mechanism. The conventional rotary switch mechanism is disclosed in for example U.S. Pat. No. 7,750,256. As shown in FIG. 1, the conventional rotary switch mechanism 1 comprises a dial assembly 12, a push button 13, a rotary switch 14, an elastic element 15, five dome switches 161~165 and a circuit board 17.

The dial assembly 12 comprises plural projecting parts 121. The push button 13 comprises a central button part 131 and a ring-shaped part 132. The ring-shaped part 132 is connected with the central button part 131 and surrounds the central button 131. The ring-shaped part 132 comprises a mounting tab 133 to be fixed in a corresponding mounting aperture 171 of the circuit board 17.

Upon rotation of the dial assembly 12, the plural projecting parts 121 interact with the handle 141 of the rotary switch 14. Consequently, the handle 141 is rotated in either the clockwise direction or the anti-clockwise direction, and different rotating signals are generated to control a specified function. Moreover, due to a restoring force resulted from the elastic element 15, the rotation of the dial assembly 12 results in a multi-step rotating feel. Moreover, by pressing the central button part 131, the dome switch 161 is triggered to generate a pressing signal. In response to the pressing signal, another function is controlled. Moreover, by pressing the surface of the dial assembly 12 to have the central button part 131 trigger the dome switches 162~165, two other functions may be controlled.

From the above discussion, the conventional rotary switch mechanism 1 may be operated to control at least four kinds of functions. For example, a playlist is selected by rotating the dial assembly 12; the sound volume is adjusted by pressing the dome switches 163 and 165; the next/previous song switching function is controlled by pressing the dome switches 162 and 164; and the playback of a song is started or paused by pressing the push button 13.

Although the conventional rotary switch mechanism 1 may be operated to control four kinds of functions, these four functions sometimes fail to meet the user's requirements because the electronic device is gradually developed to have a variety of functions. Moreover, the conventional rotary switch mechanism 1 uses many dome switches to control some specified functions. If some specified functions, for example the functions of zooming in/out an image or rotating the image, are controlled by pressing the dome switches, the pressing gestures of controlling these functions usually fail to be directly perceived through the senses of the user. Moreover, since the dial assembly 12 is in direct contact with the push button 13, the dial assembly 12 and the push button 13 usually nib against each other during rotation of the dial assembly 12. If the conventional rotary switch mechanism 1 has been long used, the abrasion between the dial assembly 12 and the push button 13 may shorten the use life of the rotary switch mechanism 1. Moreover, if the force exerted on the dial assembly 12 is not uniformly distributed, the dial assembly 12 is readily inclined toward a side to erroneously trigger the dome switches 162~165. Under this circumstance, the dial assembly 12 is erroneously operated.

Therefore, there is a need of providing an improved rotary switch mechanism so as to obviate the drawbacks encountered from the prior art.

SUMMARY OF THE INVENTION

The present invention provides a rotary switch mechanism with a plurality of controlling functions.

The present invention also provides a rotary switch mechanism with low abrasion.

The present invention further provides a rotary switch mechanism capable of prompting the user of the controlling mode.

In accordance with an aspect of the present invention, there is provided a rotary switch mechanism. The rotary switch mechanism includes a hollow cylinder, a base, a push button, a first rotatable member, a second rotatable member, a first switch, a second switch and a third switch. The hollow cylinder has a hollow portion in a center thereof. The base is disposed under the hollow cylinder, and has a perforation. The push button includes a pressing surface and a pressing rod extended from the pressing surface. The pressing surface is disposed over the hollow cylinder. The pressing rod is penetrated through the hollow cylinder and the perforation of the base and protruded outside a bottom of the base. The first rotatable member is sheathed around the hollow cylinder, and freely rotatable with respect to the hollow cylinder. The second rotatable member is sheathed around the first rotatable member, and freely rotatable with respect to the first rotatable member. The first switch is disposed beside the first rotatable member. When the first rotatable member is rotated, the first rotatable member and the first switch interact with each other to generate a first rotating signal. The second switch is disposed beside the second rotatable member. When the second rotatable member is rotated, the second rotatable member and the second switch interact with each other to generate a second rotating signal. The third switch is mounted on a first circuit board, which is disposed under the base. When the push button is pressed down, the third switch is triggered by the pressing rod to generate a pressing signal.

In an embodiment, the rotary switch mechanism further includes a second circuit board, which is disposed above the base. The first switch is disposed on a bottom surface of the second circuit board, and the second switch is disposed on a top surface of the second circuit board.

In an embodiment, the first rotatable member is a hollow pillar including an upper pillar portion and a lower pillar portion. The upper pillar portion has a diameter larger than the lower pillar portion, plural continuous toothed structures are formed on an outer periphery of a bottom of the lower pillar portion, and the first switch is disposed beside the toothed structures.

In an embodiment, the second rotatable member is a hollow annular body sheathed around the first rotatable member and includes an upper annular portion and a lower annular portion. The upper annular portion has a diameter larger than the lower annular portion. In addition, plural continuous toothed structures are respectively formed on outer peripheries of the upper annular portion and the lower annular portion. The first switch is disposed beside lower annular portion.

In an embodiment, the rotary switch mechanism further includes a supporting member, which is disposed over the base for separating the first rotatable member from the second rotatable member. In addition, the first rotatable member is penetrated through the supporting member. The second rotatable member is sheathed around the supporting member. The supporting member further includes a first sustaining member arranged beside the lower annular portion of the second rotatable member for resulting in a multi-step rotating feel. The first sustaining member includes a pushing rod, an elastic element and a fixing element.

In an embodiment, the base further includes a second sustaining member arranged beside the toothed structures of the first rotatable member for resulting in a multi-step rotating feel. The second sustaining member includes a pushing rod, an elastic element and a fixing element.

In an embodiment, the first switch is a slide switch, an infrared switch or a magnetic switch.

In an embodiment, the second switch is a slide switch, an infrared switch or a magnetic switch.

In an embodiment, the base is made of transparent material, and the rotary switch mechanism further includes a light-emitting element and a light-guiding element. The light-emitting element is disposed under the base, and the light-guiding element is a sleeve sheathed around the hollow cylinder.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a rotary switch mechanism for use in various electronic devices.

Figure 1:
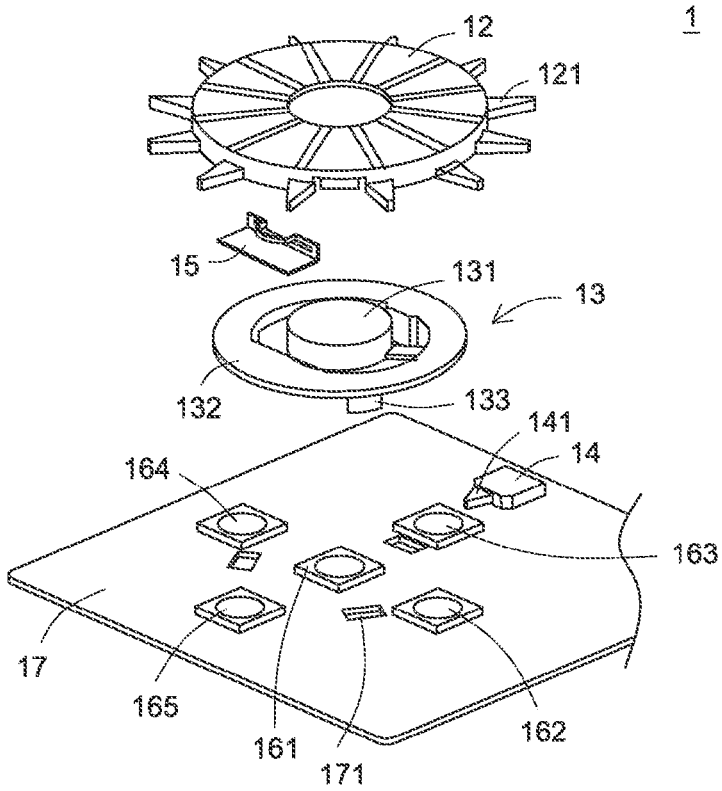
FIG. 1(PRIOR ART)
FIG. 1 is a schematic exploded view illustrating a conventional rotary switch mechanism.
Figure 2:
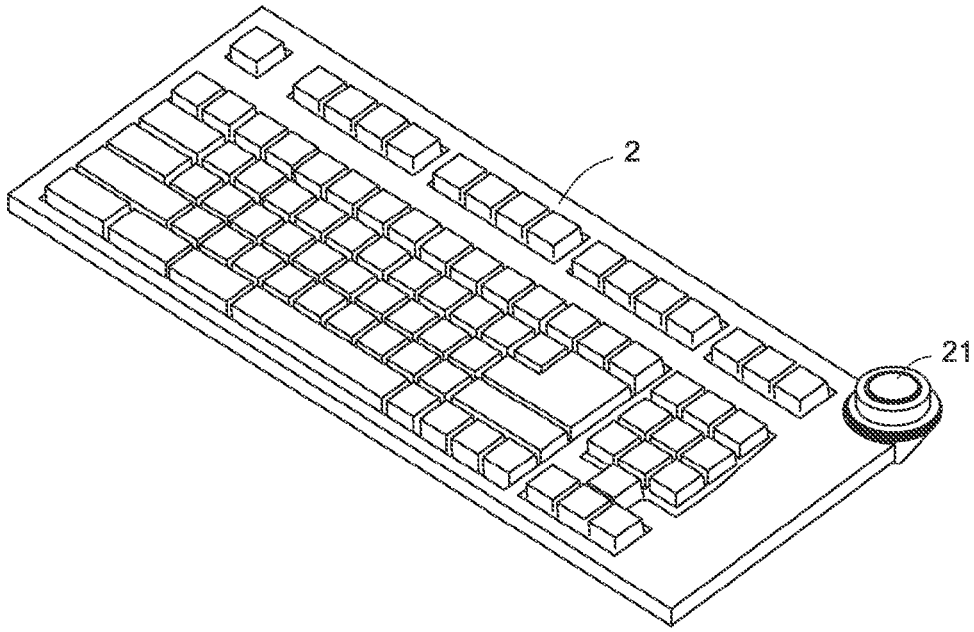
FIG. 2 is a schematic perspective view illustrating a rotary switch mechanism for use in an input device according to an embodiment of the present invention.

FIG. 2 is a schematic perspective view illustrating a rotary switch mechanism 21 for use in an input device 2 according to an embodiment of the present invention. In this embodiment, the input device 2 is a computer keyboard.

Figure 3A:
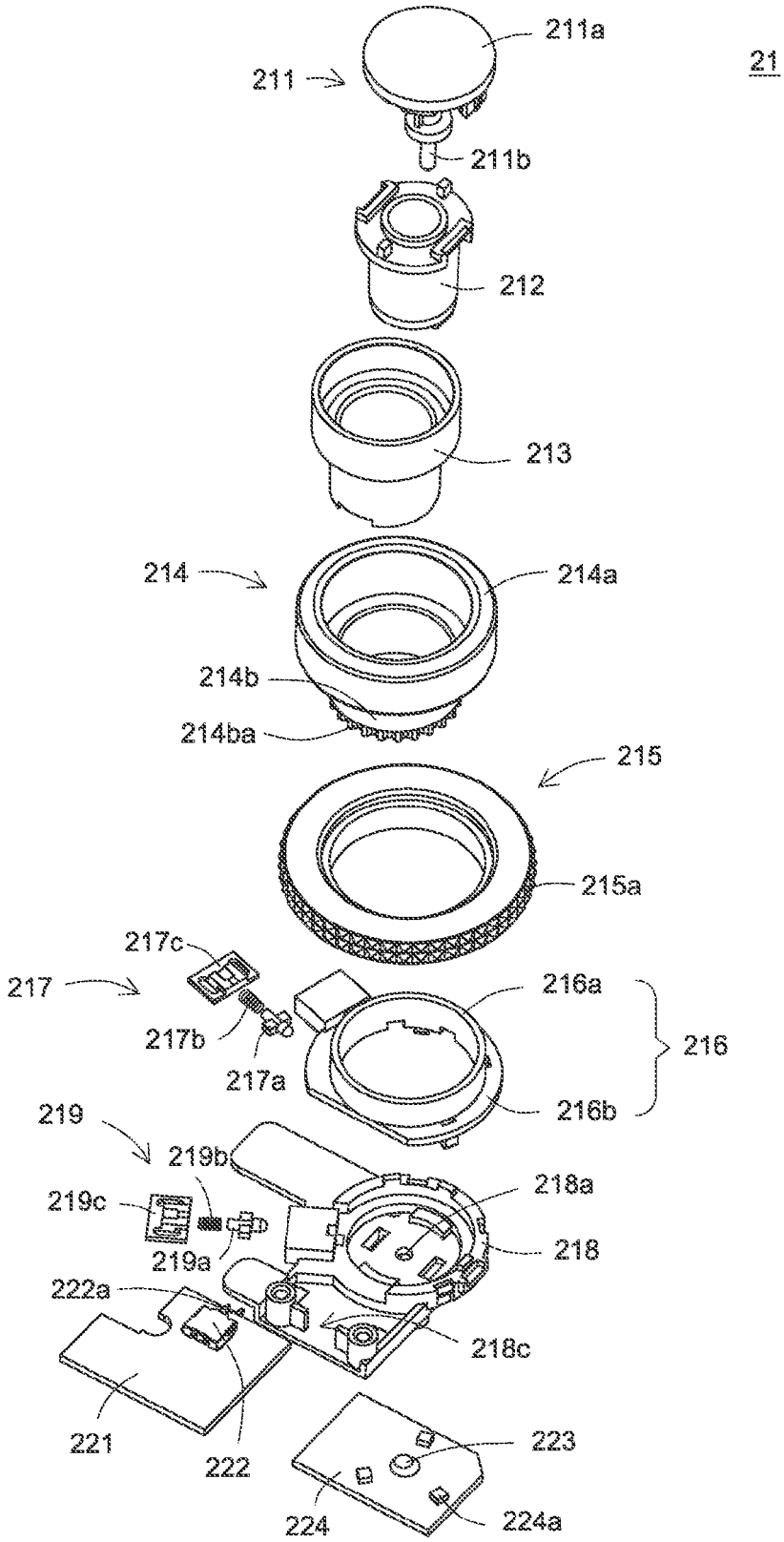
FIGS. 3A and 3B are schematic exploded views illustrating a rotary switch mechanism according to an embodiment of the present invention.
Figure 3B:
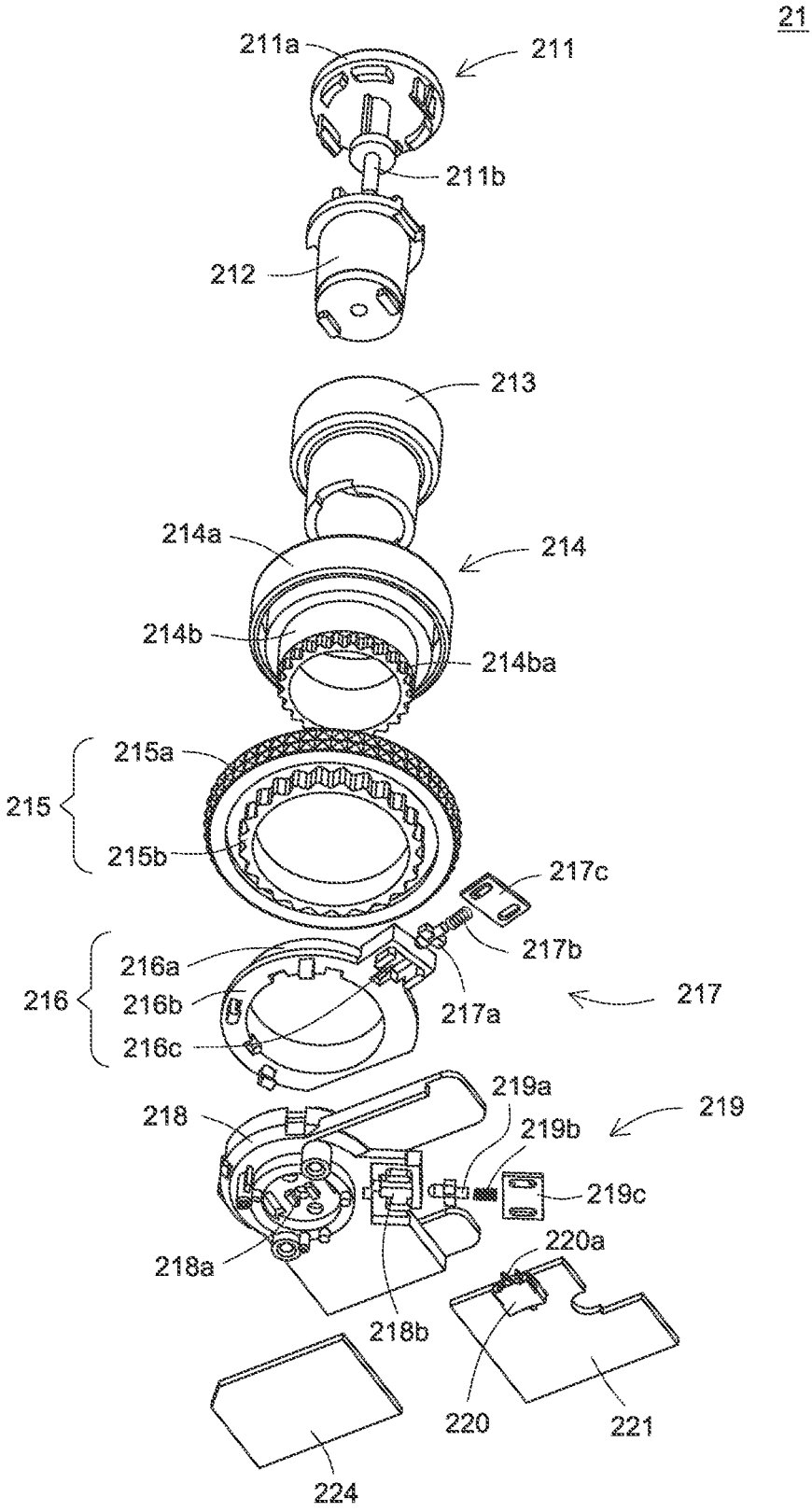

Hereinafter, the detailed structure of the rotary switch mechanism 21 will be illustrated with reference to FIGS. 3A and 3B. As shown in FIGS. 3A and 3B, the rotary switch mechanism 21 comprises a push button 211, a hollow cylinder 212, a light-guiding element 213, a first rotatable member 214, a second rotatable member 215, a supporting member 216, a first sustaining member 217, a base 218, a second sustaining member 219, a first switch 220, a second circuit board 221, a second switch 222, a third switch 223 and a first circuit board 224.

The push button 211 comprises a pressing surface 211*a* and a pressing rod 211*b*. The hollow cylinder 212 has a hollow portion in the center thereof. The light-guiding element 213 is a sleeve. In this embodiment, the first rotatable member 214 is a hollow pillar. The first rotatable member 214 comprises an upper pillar portion 214*a* with a larger diameter and a lower pillar portion 214*b* with a smaller diameter. In addition, plural toothed structures 214*ba* are formed on the outer periphery of the bottom of the lower pillar portion 214*b*. The second rotatable member 215 comprises an upper annular portion 215*a* with a larger diameter and a lower annular portion 215*b* with a smaller diameter. In addition, plural toothed structures are respectively formed on the outer peripheries of the upper annular portion 215*a* and the lower annular portion 215*b*. The supporting member 216 comprises a hollow ring-shaped raised portion 216*a*, a protruding edge 216*b* and a recess 216*c*. The protruding edge 216*b* is externally and vertically extended from the ring-shaped raised portion 216*a*. The recess 216*c* is formed on the protruding edge 216*b*. The first sustaining member 217 comprises a pushing rod 217*a*, an elastic element 217*b* and a fixing element 217*c*. The base 218 is made of transparent material. The base 218 comprises a central perforation 218*a*, a recess 218*b* and a receptacle 218*c*. The recess 218*b* is formed in an outer periphery of the base 218. The second sustaining member 219 comprises a pushing rod 219*a*, an elastic element 219*b* and a fixing element 219*c*. The first switch 220 is a slide switch including a first handle 220*a*. The second switch 222 is also a slide switch including a second handle 222*a*. The third switch 223 is a tactile switch including a position-resetting structure. In addition, plural light-emitting elements 224*a* are mounted on the first circuit board 224. In some embodiments, the first switch 220 and the second switch 222 may be infrared switches or magnetic switches.

Hereinafter, a process of assembling the rotary switch mechanism 21 of the present invention will be illustrated with reference to FIGS. 3A and 3B. First of all, the light-guiding element 213 is sheathed around the hollow cylinder 212. The first rotatable member 214 is sheathed around the light-guiding element 213, so that the first rotatable member 214 is freely rotatable with respect to the light-guiding element 213. Then, the supporting member 216 is sheathed around the outer periphery of the lower pillar portion 214*b* of the first rotatable member 214 to separate the first rotatable member 214 from the second rotatable member 215. The second rotatable member 215 is sheathed around the ring-shaped raised portion 216*a* of the supporting member 216, so that the second rotatable member 215 is freely rotatable with respect to the supporting member 216. Then, the pushing rod 217*a* of the first sustaining member 217 is penetrated through the elastic element 217*b*, accommodated within the recess 216*c* of the supporting member 216, and then fixed in the supporting member 216 by the fixing element 217*c*. In such way, the pushing rod 217*a* is protruded to a side of the lower annular portion 215*b* of the second rotatable member 215. Then, by means of screws (not shown), the base 218 is fastened onto the bottom of the hollow cylinder 212 in order to fix and support the resulting structure of the above components. Then, the pushing rod 219*a* of the second sustaining member 219 is penetrated through the elastic element 219*b*, accommodated within the recess 218*b* of the base 218, and then fixed in the base 218 by the fixing element 219*c*. In such way, the pushing rod 219*a* is protruded to a side of the toothed structures 214*ba* of the lower pillar portion 214*b* of the first rotatable member 214.

Moreover, the second circuit board 221 is partially accommodated within the receptacle 218*c*, which is arranged at an edge of the base 218. The first switch 220 is disposed on a bottom surface of the second circuit board 221, and the first handle 220*a* is disposed beside the toothed structures 214*ba* of the first rotatable member 214. The second switch 222 is disposed on a top surface 221 of the second circuit board 221, and the second handle 222*a* is disposed beside the lower annular portion 215*b* of the second rotatable member 215. The first circuit board 224 is disposed under the base 218. The third switch 223 is disposed on a top surface of the first circuit board 224. Afterwards, the pressing surface 211*a* of the push button 211 is disposed over the hollow cylinder 212, and successively penetrated through the hollow portion of the hollow cylinder 212 and the perforation 218*a* of the base 218. Meanwhile, by pressing down the push button 211, the third switch 223 is triggered.

Figure 4:
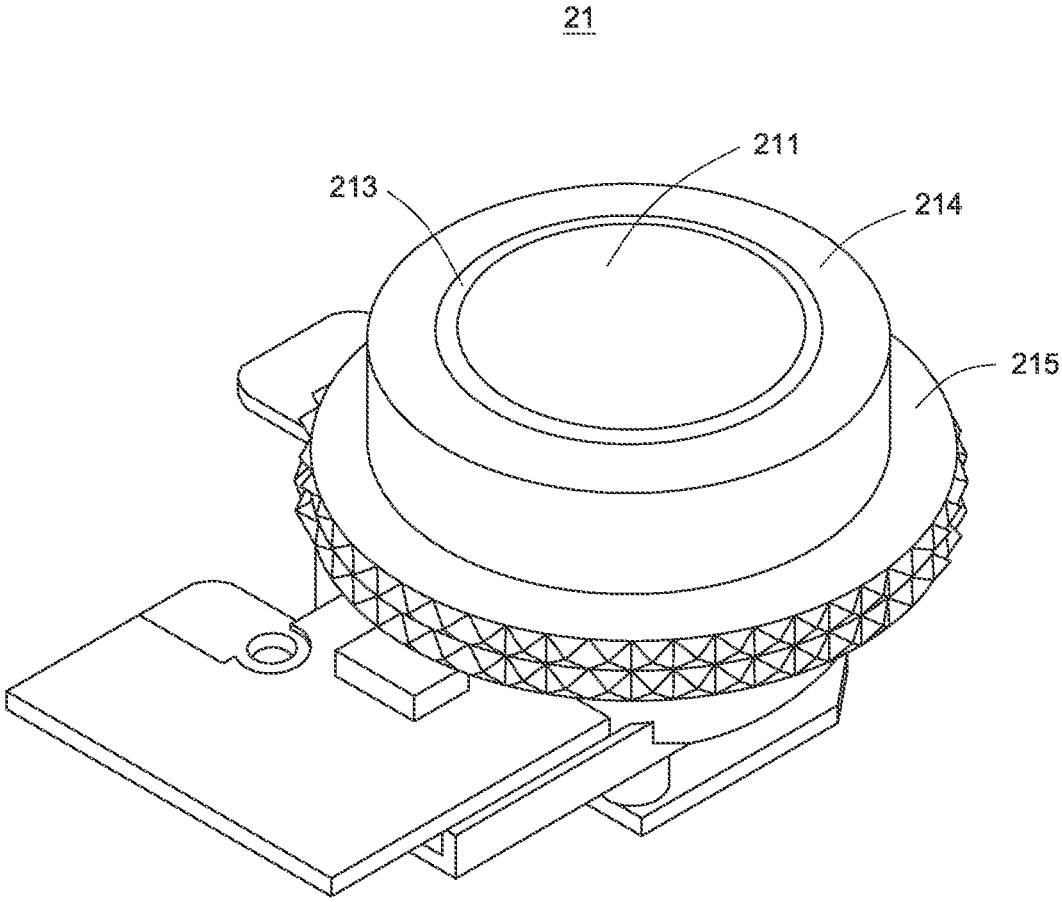
FIG. 4 is a schematic perspective view illustrating the outward appearance of the rotary switch mechanism according to an embodiment of the present invention.

FIG. 4 is a schematic perspective view illustrating the outward appearance of the rotary switch mechanism 21 according to an embodiment of the present invention. As shown in FIG. 4, the outward appearance of the rotary switch mechanism 21 comprises the push button 211, the light-guiding element 213, the first rotatable member 214 and the second rotatable member 215. Hereinafter, the application of the rotary switch mechanism to a computer keyboard will be illustrated with reference to FIGS. 2 and 4.

After the input device 2 is in communication with a computer system, the rotary switch mechanism 21 may be operated to control diversified functions of the computer system. For example, in a case that the push button 211 is long pressed for 5 minutes, the rotary switch mechanism 21 is activated. Whereas, in a case that the push button 211 is shortly pressed, the playback of a song is started or paused. The light-guiding element 213 may provide a function of prompting and warning the user. The first rotatable member 214 is operated to control sound volume. The second rotatable member 215 is operated to zoom in or zoom out the image shown on the computer monitor.

Figure 5:
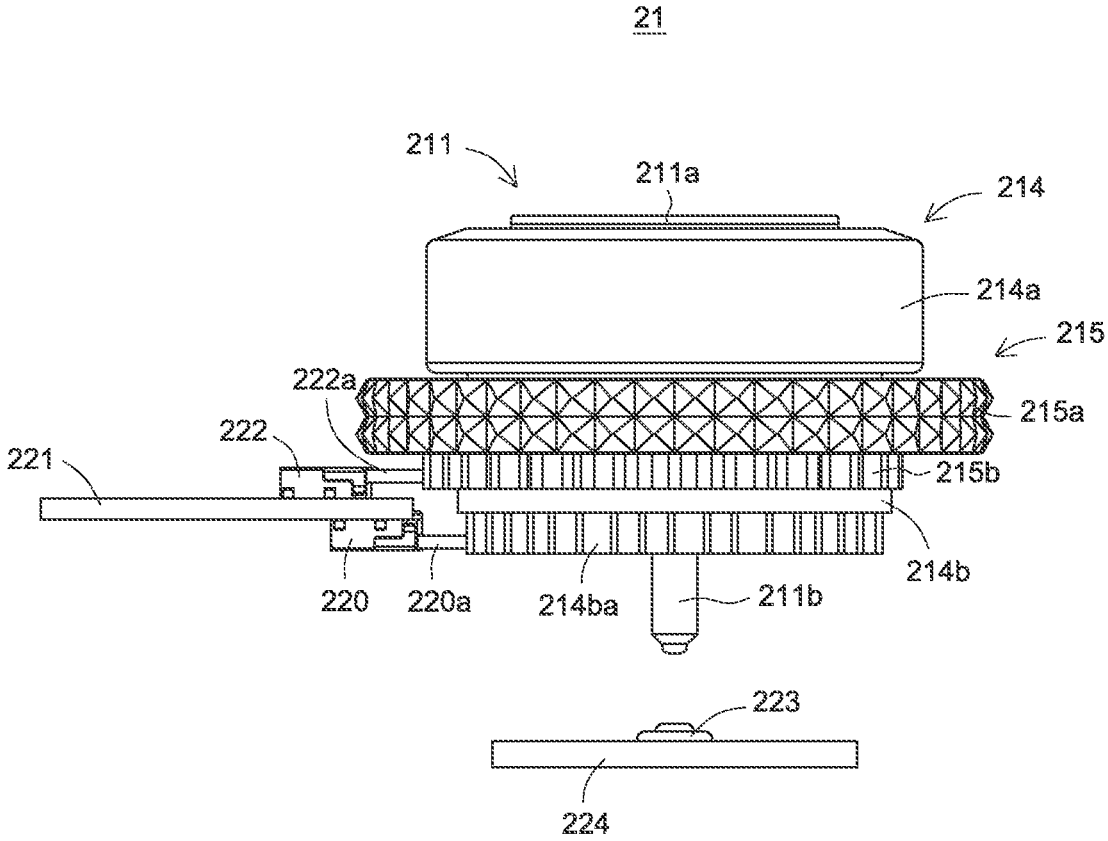
FIGS. 5 and 6 are schematic cross-sectional views illustrating the rotary switch mechanism according to an embodiment of the present invention.
Figure 6:
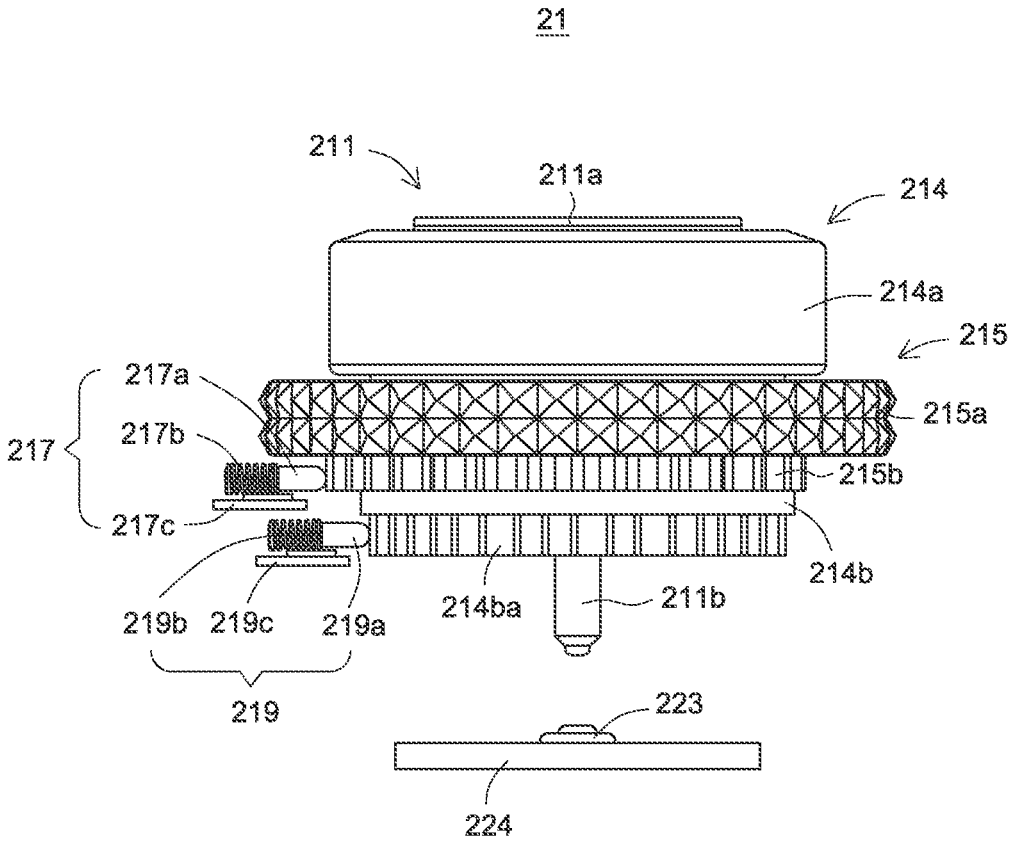

Please refer to FIGS. 5 and 6. For operating the rotary switch mechanism 21, the push button 211 needs to be long pressed. When the user wants to adjust the sound volume, the upper pillar portion 214*a* of the first rotatable member 214 is rotated in a clockwise direction. Accordingly, the first handle 220*a* of the first switch 220 is moved by the toothed structures 214*ba* of the first rotatable member 214 to be rotated in an anti-clockwise direction. Meanwhile, the first switch 220 generates a first rotating signal. In response to the first rotating signal, the sound volume is increased. When the rotation of the first rotatable member 214 is stopped, the first handle 220*a* is no longer affected by the pushing force of the toothed structures 214*ba*, and thus the first handle 220*a* is returned to its original position. In this situation, the first rotating signal is no longer generated, and the adjustment of sound volume is completed.

On the other hand, if the first rotatable member 214 is rotated in the anti-clockwise direction, the first handle 220*a* of the first switch 220 is moved by the toothed structures 214*ba* to be rotated in the clockwise direction. Meanwhile, the first switch 220 generates another first rotating signal, and thus the sound volume is decreased.

Moreover, during the first rotatable member 214 is rotated, the drag force between the concave portions of the plural toothed structures 214*ba* and the pushing rod 219*a* should be overcome, so that the pushing rod 219*a* is movable along the rims of the toothed structures 214*ba*. In this situation, the elastic element 219*b* is in a compressed state. As the first rotatable member 214 is continuously rotated, the next concave portion of the plural toothed structures 214*ba* is moved to a position beside the pushing rod 219*a*. Due to the elastic restoring force of the elastic element 219*b*, the pushing rod 219*a* is engaged with this next concave portion of the plural toothed structures 214*ba*. In such way, the rotation of the first rotatable member 214 results in a multi-step rotating feel for facilitating the user to realize the rotating extent.

Similarly, when the user wants to zoom in or zoom out the image shown on the computer monitor, the upper annular portion 215*a* of the second rotatable member 215 may be rotated in a clockwise direction or an anti-clockwise direction. Accordingly, the second handle 222*a* of the second switch 222 is moved by the toothed structures of the lower annular portion 215*b* to be rotated in the anti-clockwise direction or the clockwise direction. Meanwhile, the second switch 222 generates a second rotating signal. In response to the second rotating signal, the image shown on the computer monitor is enlarged or shrunken. Likewise, by means of the first sustaining member 217, the rotation of the second rotatable member 215 also results in a multi-step rotating feel for facilitating the user to realize the rotating extent. In this embodiment, plural continuous toothed structures are also formed on the outer periphery of the upper annular portion 215*a* of the second rotatable member 215. As a consequence, during operation of the rotary switch mechanism 21, the user may easily distinguish the first rotatable member 214 from the second rotatable member 215 without the need of looking at the second rotatable member 215. In this situation, the operation of the rotary switch mechanism 21 is user-friendly, and the possibility of causing erroneous operation will be minimized. Moreover, when the user wants to play a song, the push button 211 may be pressed down, so that a downward force is exerted on the third switch 223 through the pressing rod 211*b*. In this situation, the third switch 223 is triggered to generate a pressing signal. In response to the pressing signal, the playback of the song is controlled. When the push button 211 is no longer pressed down, the third switch 223 is automatically returned to its original position, and thus the pressing signal is no longer generated.

Moreover, the plural light-emitting elements 224*a* mounted on the first circuit board 224 may emit light beams with various light colors. The light beams are transmitted to the light-guiding element 213 through the base 218 to result in a ring of light, thereby warning and prompting the user. For example, when the user wants to operate the rotary switch mechanism 21, the user may press down the push button 211 until the light-guiding element 213 results in a ring of light. The ring of light denotes that the rotary switch mechanism 21 is activated. If the user immediately adjusts the sound volume by rotating the first rotatable member 214, the light-guiding element 213 results in a ring of light with another light color to facilitate the user to realize the current adjusting mode. For example, if the sound volume is too high, the light-guiding element 213 results in a ring of red light to prompt the user.

It is noted that the first rotatable member 214, the second rotatable member 215 and the push button 211 of the rotary switch mechanism 21 are independent of each other. That is, by operating the first rotatable member 214, the second rotatable member 215 and the push button 211, respective functions are controlled. In some embodiments, by simultaneously operating the first rotatable member 214, the second rotatable member 215 and/or the push button 211, expanded functions are controlled. For example, by simultaneously pressing down the push button 211 and rotating the first rotatable member 214, the image shown on the computer monitor may be correspondingly rotated. In addition, by simultaneously pressing down the push button 211 and rotating the second rotatable member 215, the Page Up/Down function is achievable.

In the above embodiment of the rotary switch mechanism 21, the first switch 220 and the second switch 222 are respectively disposed on the bottom surface and the top surface of the second circuit board 224, so that a two-layered rotary switch mechanism is obtained. Since the first rotatable member 214, the second rotatable member 215 and the push button 211 are separated from each other by the hollow cylinder 212, the first rotatable member 214, the second rotatable member 215 and the push button 211 may be independently operated. In this situation, two of these components may be simultaneously operated to execute respective functions. That is, the rotary switch mechanism 21 may be operated to control diversified functions without being limited to the number of controlling components. Moreover, since the first rotatable member 214, the second rotatable member 215 and the push button 211 are independent of each other, the abrasion between the rotatable members and the push button will be largely reduced, and the use life of the rotary switch mechanism will be prolonged. Moreover, the use of the light-guiding element 214 may facilitate the user to realize the current controlling mode and status, thereby increasing the convenience of operating the rotary switch mechanism.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A rotary switch mechanism, comprising:

a hollow cylinder having a hollow portion in a center thereof;

a base disposed under said hollow cylinder, and having a perforation;

a push button comprising a pressing surface and a pressing rod extended from said pressing surface, wherein said pressing surface is disposed over said hollow cylinder, and said pressing rod is penetrated through said hollow cylinder and said perforation of said base and protruded outside a bottom of said base;

a first rotatable member sheathed around said hollow cylinder, and freely rotatable with respect to said hollow cylinder;

a second rotatable member sheathed around said first rotatable member, and freely rotatable with respect to said first rotatable member;

a first switch disposed beside said first rotatable member, wherein when said first rotatable member is rotated, said first rotatable member and said first switch interact with each other to generate a first rotating signal;

a second switch disposed beside said second rotatable member, wherein when said second rotatable member is rotated, said second rotatable member and said second switch interact with each other to generate a second rotating signal; and a third switch mounted on a first circuit board, which is disposed under said base, wherein when said push button is pressed down, said third switch is triggered by said pressing rod to generate a pressing signal.

2. The rotary switch mechanism according to claim 1 further comprising a second circuit board, which is disposed above said base, wherein said first switch is disposed on a bottom surface of said second circuit board, and said second switch is disposed on a top surface of said second circuit board.

3. The rotary switch mechanism according to claim 1 wherein said first rotatable member is a hollow pillar including an upper pillar portion and a lower pillar portion, wherein said upper pillar portion has a diameter larger than said lower pillar portion, plural continuous toothed structures are formed on an outer periphery of a bottom of said lower pillar portion, and said first switch is disposed beside said toothed structures.

4. The rotary switch mechanism according to claim 3 wherein said second rotatable member is a hollow annular body sheathed around said first rotatable member and including an upper annular portion and a lower annular portion, wherein said upper annular portion has a diameter larger than said lower annular portion, plural continuous toothed structures are respectively formed on outer peripheries of said upper annular portion and said lower annular portion, and said first switch is disposed beside lower annular portion.

5. The rotary switch mechanism according to claim 4 further comprising a supporting member, which is disposed over said base for separating said first rotatable member from said second rotatable member, wherein said first rotatable member is penetrated through said supporting member, said second rotatable member is sheathed around said supporting member, said supporting member further comprises a first sustaining member arranged beside said lower annular portion of said second rotatable member for resulting in a multi-step rotating feel, and said first sustaining member comprises a pushing rod, an elastic element and a fixing element.

6. The rotary switch mechanism according to claim 4 wherein said base further comprises a second sustaining member arranged beside said toothed structures of said first rotatable member for resulting in a multi-step rotating feel, wherein said second sustaining member comprises a pushing rod, an elastic element and a fixing element.

7. The rotary switch mechanism according to claim 1 wherein said first switch is a slide switch, an infrared switch or a magnetic switch.

8. The rotary switch mechanism according to claim 1 wherein said second switch is a slide switch, an infrared switch or a magnetic switch.

9. The rotary switch mechanism according to claim 1 wherein said base is made of transparent material, and said rotary switch mechanism further comprises a light-emitting element and a light-guiding element, wherein said light-emitting element is disposed under said base, and said light-guiding element is a sleeve sheathed around said hollow cylinder.

* * * * *